United States Patent [19]

Kaneko et al.

[11] Patent Number: 4,828,951

[45] Date of Patent: May 9, 1989

[54] METHOD FOR THE FORMATION OF MULTICOLOR IMAGES

[75] Inventors: Tadashi Kaneko; Yoshiaki Kobayashi; Mitsutaka Arai, all of Hachioji, Japan

[73] Assignee: Konica Corporation, Tokyo, Japan

[21] Appl. No.: 168,410

[22] Filed: Mar. 15, 1988

[30] Foreign Application Priority Data

Mar. 19, 1987 [JP] Japan ..... 62-67444

[51] Int. Cl.[4] ..... G03G 13/01

[52] U.S. Cl. ..... 430/47; 430/45; 430/110; 430/126

[58] Field of Search ..... 430/45, 47, 126

[56] References Cited

U.S. PATENT DOCUMENTS 3,998,634 12/1976 Iwasa ..... 430/45 X
4,629,669 12/1986 Shoji et al. ..... 430/47
4,640,882 2/1987 Mitsuhashi et al. ..... 430/126 X

FOREIGN PATENT DOCUMENTS 57-30847 2/1982 Japan ..... 430/47

*Primary Examiner*—Roland E. Martin
*Attorney, Agent, or Firm*—Jordan B. Bierman

[57] ABSTRACT

An image forming method by the electrophotographic process is disclosed. The image forming method comprises the steps of forming a plurality of toner images different in color on an image carrying member by repeating the developing of the electrostatic latent image on the image carrying member with developers containing both toner and carrier, and transferring said plurality of the toner images at a time onto a receiving material, in which the toner to be provided for at least the initial toner image formation is mixed with 0.2 to 2% by weight of metal oxide particles having a BET specific surface area determined by nitrogen adsorption of from 30 $m^2/g$ to 60 $m^2/g$. The method provides clear multicolor images free from any deterioration in the resolution due to transfer doubling trouble as well as in the image quality due to transfer-off spots.

9 Claims, 6 Drawing Sheets

METHOD FOR THE FORMATION OF MULTICOLOR IMAGES

FIELD OF THE INVENTION

The present invention relates to a method for the formation of images in which a plurality of toner images different in color are formed on an image carrier and then transferred at a time onto a copying sheet to thereby form a multicolor image.

BACKGROUND OF THE INVENTION

Conventional electrophotographic methods of forming multicolor images, as described in, for example, Japanese Patent Publication Open to Public Inspection (hereinafter referred to as Japanese Patent O.P.I. Publication) Nos. 27537/1972, 58452/1984 and the like, are performed generally in the manner of repeating the steps comprising uniformly charging a photoreceptor, imagewise-exposing the photoreactor to a separate color light to form a latent image, color developing the latent image and transferring the formed color image onto a copying sheet of paper. In such the image forming method, diferent color toner images such as of yellow, magenta, cyan, black, and the like, are transferred to be superposed, one upon another each time when one color toner image is formed on an image carrier, onto a sheet of copying paper wound around a transfer drum to thereby form a multicolor image on the sheet.

According to the above image forming method, more abundant information can be obtained than in the case of copying in black and white alone, so that the method is favorable in this respect, but it requires a transfer drum, thus causing the apparatus therefor to be of great bulk. In addition, the method has a problem that when the different color toner images are transferred, by way of superposing one color toner image upon another, onto a sheet wound around the transfer drum, transfer doubling trouble tends to appear, thus causing the resulting image to be deteriorated in the resolution. Upon this, for example, Japanese Patent O.P.I. Publication No. 144452/1981 describes a technique for forming on an image carrier a multicolor toner image comprised of a plurality of different color toners in order that the transfer thereof can be completed only at a time and at the same time the apparatus therefor can be of a compact size.

Further, the above publication also discloses another technique in which, when forming on an image carrier a superposed multicolor toner image in serial developing processes, in order to avoid such a problem that the subsequent development disturbs the toner image formed on the image carrier by the preceding development, the preceding image's toner turns back to cause a mixed color, and so forth, an AC bias voltage is applied between the image carrier and the developer transport carrier in the developing region to thereby form an oscillating electric field to thus effect the development by a non-contact method.

In such the image forming method, however, because a plurality of toner images are superposed to be formed in the same region on an image carrier and then transferred at a time on a copying material unlike the manner of forming a multicolor image by repeating the development/transfer procedure, there occur the following problems with respect to the image transfer:

(1) It takes time from the formation of the initial toner image until the transfer, and in the meantime both the combinating force due to Van der Waals force tht acts between the foregoing toner image and the image carrier and the combining force due to the image force become strengthened, thereby making it hard to perform the image transer.

(2) Even if an exposure prior to the transfer or charge elimination prior to the transfer is made in order to weaken the combining force between the initial toner image and the image carrier, its effect is not exhibited particularly when toner images are superposedly formed because the effect is intercepted by the toner image layers formed over the initial toner image.

(3) Since the toner image is formed according to the non-contact developing manner, the toner is driven at a high speed onto the surface of the image carrier, thus further increasing the combining force due to the foregoing Van der Waals force and the combining force due to the image force.

Accordingly, where a multicolor image is formed in accordance with the above image forming method, transfer-off spots appear particularly in a solid density area of the image, thus causing the image to be an awkward image. Where a sheet of paper is used as the copying material, a transfer-off trouble according to the grain marks of paper occurs, thus forming an even more awkward image.

As the above-mentioned image carrier, there are photoreceptors having thereon a photosensitive layer formed by dispersing, e.g., ZnO, $TiO_2$, CdS, etc., into a resin, photoreceptors comprising an amorphous selenium photosensitive layer, and photoreceptors having an organic photoconductor. Of these image carriers, in a photoreceptor such as, e.g., the OPC photoreceptor, having on the surface thereof a relatively soft photosensitive layer, when the image-forming process is repeated to superpose a plurality of toner images on the photoreceptor, especially the first toner image is strongly attached onto the surface of the photoreceptor, and even if the final multicolor toner image is tried to be electrostatically transferred onto a copying material by using, e.g., a corona discharger or the like, transfer marks or transfer-off marks appear, so that no satisfactory image transfer can be accomplished. Further, of the above-mentioned OPC photoreceptors, in double-layered photoreceptors comprising a conductive support having thereon a carrier generating layer containing a carrier generating material such as, e.g., a bisazo-type pigment or the like, and, superposed thereon, a carrier transport layer containing a carrier transport material such as an aromatic amino compound, hydrazone compound, pyrazoline compound, amine derivative or the like, the carrier transport layer as the surface layer is relatively soft, so that the aforementioned transfer trouble occurs conspicuously. The reason why such the problem occurs is considered probably because the first toner image out of a plurality of toner images is attached for a relatively long time onto the image carrier, and the image force, which in the meantime continues to function between the toner particles and the image carrier, brings the toner particles into more close contact with the surface of the image carrier, and consequently the image force becomes more and more strongly functions and at the same time Van der Waals force also strongly functions.

In addition, where a laser light modulated according to digitalized image information is used as a light source, the reversal developing method to attach a toner to an exposed region is preferably used, but in transferring onto a copying material a multicolor toner image that has been obtained by repeating such the developing process, there occurs the problem of causing a repellency phenomenon when an exposure is applied prior to the image transfer for improving the transfer efficiency.

Therefore, the transfer of the multicolor toner image formed by using the reversal developing process comes to be up against even more difficult problems.

Incidentally, the occurrence of the above-mentioned repellency phenomenon is considered due to the following mechanism: That is, in the case where a multicolor toner image is formed by repeating the reversal developing process, the recharging being made during the period up to the image transfer causes the multicolor toner image and the image carrier's surface therearound to become highly charged. Hereupon, if an exposure prior to the image transfer is given, the high charge on the toner image remains intact, but the charge on its peripheral portion of the image carrier is erased, so that a high potential difference is produced between the toner image and its peripheral area of the image carrier, whereby part of the toner image is repelled by the action of the strong line of electrostatic force therebetween, thus resulting in the toner image losing its resolution.

In the method for transferring at a time onto an image carrier such as an electrophotographic photoreceptor a multicolor toner image comprised of a plurality of superposed toner images as mentioned above, the image-forming apparatus to be used therefor has advantages that it can be of a compact type despite its plurality of developing devices being incorporated therein, forms no transferred image doubling trouble, and enables to obtain images having highly excellent resolution. On the other hand, however, the apparatus is poor in the transferrability of the toner image onto a copying material, and produces transfer-off spots, resulting in awkward images. And if the surface of the image carrier used is relatively soft as that of a photoreceptor which uses, e.g., anorganic photoconductive material, the transferrability becomes even worse. We, as a result of our continued investigation about the above-mentioned problems, have now found a method for weakening the combining force of a toner image onto the aforementioned image carrier, and for improving the transferrability.

SUMMARY OF THE INVENTION

It is an object of the present invention to provide a method for the formation of multicolor images which comprises the improvement of the image transferrability in the image forming method of the type of superposedly forming a plurality of toner images on an image carrier and transferring them at a time on a copying material, and which thus is capable of forming high-quality, sharp and clear multicolor images free from any deterioration in the resolution due to transfer doubling trouble as well as in the image quality due to transfer-off spots.

The above object of the present invention is accomplished by a method for forming an image comprising the steps of forming a plurality of toner images different in color on an image carrying member by repeating the developing of the electrostatic latent image on the image carrying member with developers containing both toner and carrier, and transferring said plurality of the toner images at a time onto a receiving material, in which the tomer to be provided for at least the initial toner image formation is mixed with 0.2 to 2% by weight of metal oxide particles having a BET specific surface area determined by nitrogen absorption of from 30 $m^2/g$ to 60 $m^2/g$.

DETAILED DESCRIPTION OF THE INVENTION

Figure 1:
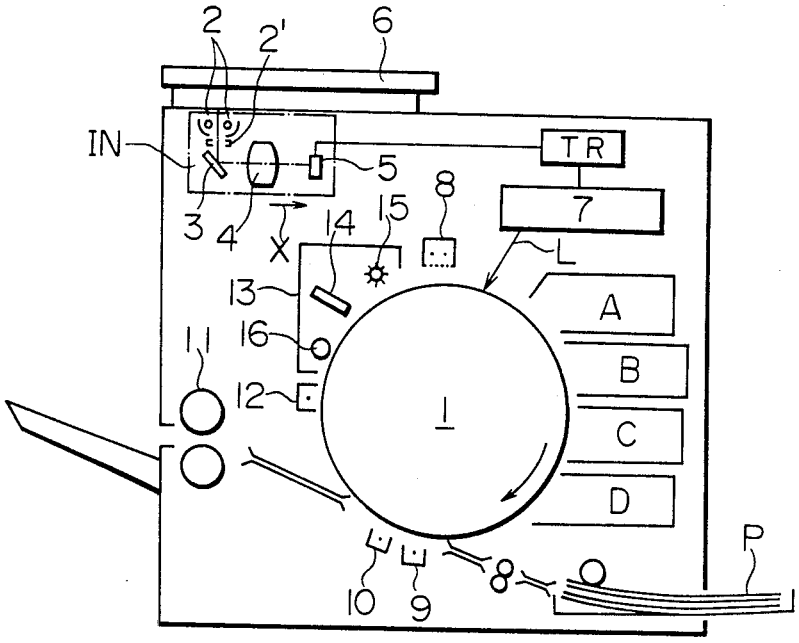
FIG. 1 is a cross-sectional view of an example of the multicolor image forming apparatus usable in this invention.

In the image forming method of this invention, an image carrier is charged and then imagewise exposed to thereby form an electrostatic latent image thereon, the electrostatic latent image is then developed by using a two-component developer comprised of both carrier and toner in the non-contact developing process preferably under the condition of an oscillating electric field, said developing process being repeated to superpose different color toner images to thereby form a multicolor toner image is then transferred at a time according to, e.g., the electrostatic transfer process, onto a copying material. The developer to be used herein, since it is a two-component developer, is advantageous in respect that its triboelectric charge is easily controllable, there is no need of incorporating a magnetic material, which is generally nearly black, into its toner, so that clear-color toners can be used, thus enabling the formation of a clear multicolor toner image. Also, the formation of a multicolor toner image by superposing different color tone images upon an image carrier and transferring the multicolor toner image at a time onto a copying material make it unnecessary to use any large-size transfer drum, thus causing the apparatus therefor to be of a compact type, and it produces no transfer doubling trouble, so that it prevents the resolution from being deteriorated, thus enabling to obtain a high-resolution multicolor image.

In addition, in superposedly forming different color toner images by performing a series of developing processes in the manner that an AC bias voltage is applied between the image carrier and the developer transport carrier and the development is made with the developer layer which is not allowed to be in contact with the latent image on the image carrier, the improvement is so designed as to remove such the evil as the damage of the preceding toner image by the subsequent development or the color turbidity caused by mixing in of a different color toner, and further to cause no sticking of the carrier and toner onto the background area even in the case of developing an electrostatic latent image by, e.g., the reversal developing process, whereby a fog-free, high-quality clear multicolor image can be obtained.

As has been described above, the image forming method of this invention takes various measures in order to obtain high-quality multicolor images, and besides, is so designed that the multicolor toner image formed on the image carrier can be highly efficiently transferred onto a copying material to thereby enable to attain the obtaining of even higher-quality images. That is, metal oxide particles are added to at least the toner of the developer for forming the initial toner image to thereby cover the surface of the toner particles with the metal oxide particles. Thus, the toner particles of the initial toner image are to be in contact indirectly through the metal oxide particles with the surface of the image carrier, and therefore the Van der Waals force and image force which act between the image carrier's surface and the toner particles become weakened, whereby, when the subsequent toner image is superposedly formed and then transferred at a time onto a copying material, all the toner images can be efficiently transferred. The metal oxide particles capable of exhibiting such the effect are particles having a BET specific surface by nitrogen adsorption of from 30 $m^2/g$ to 60 $m^2/g$. The measurement of the BET specific surface may be performed under a standard condition by using a commercially available Model 2200 BET specific surface measuring instrument, manufactured by Micromeritic Co. And the metal oxide particles preferably have an electric volume resistivity of at least $10^6\Omega cm$. Examples of the aforementioned metal oxide particles usable in this invention include silicon oxide, tin oxide, calcium oxide, barium oxide, strontium oxide, cerium oxide, chromium oxide, nickel oxide, iron oxide, zirconium oxide and the like. Of these oxides, those having a color such as white or nearly white, giving no color turbidity to the toner, may be suitably used. Further, the foregoing metal oxide particles may be made hydrophobic or highly resistant by having the surface thereof thinly coated with, e.g., a silane coupling agent, titanium coupling agent, drying oil such as linseed oil or tung oil, semi-drying oil such as cotton seed oil or soybean oil, nondrying oil such as castor oil, silicone oil, resin or the like.

The foregoing metal oxide particles according to this invention may be added in an amount of from 0.2 to 2% by weight to the toner to thereby cover the surface of the toner. If the adding amount is less than 0.2% by weight, the toner is not sufficiently covered, so that the transferrability cannot be improved, while if the amount exceeds 2% by weight, the amount of the metal oxide particles in the developer becomes so excessive as to deteriorate the frictional chargeability or the metal oxide particles attach to the photoreceptor to cause a charging failure, whereby the image quality may be disturbed. And if the BET specific surface of the foregoing metal oxide particles is less than 30 $m^2/g$, the abrasive property of the metal oxide particles against the image carrier becomes strengthened, so that the image carrier tends to be scratched, while if it exceeds 60 $m^2/g$, the function of the metal oxide particles to lower the Van der Waals force and image force is deteriorated.

To add further for caution's sake, the technique for incorporating such metal oxide particles as, e.g., aluminum oxide, titanium oxide, zinc oxide or the like, into a developer is of the prior art; for example, Japanese Patent O.P.I. Publication No. 136752/1985 describes the incorporation into the toner of metal oxide particles having a BET specific surface of from 0.2 to 30 $m^2/g$, preferably from 0.5 to 15 $m^2/g$, and more preferably from 1.0 to 6.0 $m^2/g$, in an amount of from 0.1 to 30% by weight to the toner. However, the technique disclosed in the above publication is only for the purpose of clearing the image carrier out of the residual toner and paper dust, etc., and is in itself quite different from that of this invention, which is for the purpose of improving the transferrability; particularly the improvement of the transferrability when transferring the plurality of toner images at a time onto a copying material in the process of repeating a plural number of times the procedure comprising charging, exposure and developing steps. Accordingly the metal oxide particles to be used are of a large particle size than in the case of this invention, and where such particles are applied to this invention, as has been aforementioned, their abrasive property against the image carrier increases to cause the image carrier to be scratched and deteriorates the chargeability of the developer, and further deteriorates the image quality.

The method for producing a toner by adding the foregoing metal oxide particles thereto is as follows: A binder resin, coloring agent and, if necessary, other additives such as antioffset agent, etc., are mixed, kneaded with heating, cooled, pulverized, classified and, if necessary, subjected to heat treatment, thereby obtaining a toner having a weight average toner size of from 5 to 30 $\mu m$ and also having a volume resistivity of not less than $10^{13}\Omega cm$, and preferably not less than $10^{14}\Omega cm$. Alternatively, into the monomer of a binder resin are incorporated the above coloring agent and a polymerization initiator, and the mixture may be thermally polymerized to thereby obtain a toner. To the thus obtained toner are added, with stirring, 0.2 to 2% by weight of the foregoing metal oxide particles, whereby the final toner of this invention can be obtained.

As the binder resin to be used for the foregoing toner, any of various resins may be used with no particular restriction thereto.

In the case where as the binder resin, for example, a polyester resin is used, examples of the alcohol for use in obtaining the polyester resin include diols such as, e.g., ethylene glycol, diethylene glycol, triethylene glycol, 1,2-propylene glycol, 1,3-propylene glycol, 1,4-butandiol, neopentyl glycol, 1,4-butendiol, etc.; etherified phenols such as 1,4-bis(hydroxymethyl)cyclohexanone, bisphenol A, hydrogenated bisphenol A, polyoxyethylenated bisphenol A, polyoxypropylenated bisphenol A, etc.; dihydric alcohol monomers obtained by substituting these with a saturated or unsaturated hydrocarbon group having 3 to 22 carbon atoms; and other dihydric alcohol monomers.

Examples of the carboxylic acid for use in obtaining the polyester resin include maleic acid, fumaric acid, mesaconic acid, citraconic acid, itaconic acid, glutaconic acid, phthalic acid, isophthalic acid, terephthalic acid, cyclohexandicarboxylic acid, succinic acid, adipic acid, sebacic acid, malonic acid; dihydric organic acid monomers obtained by substituting these with a saturated or unsaturated hydrocarbon group having 3 to 22 carbon atoms; acid anhydrides of these acids; lower alkyl ester/linolenic acid dimers; and other dihydric organic acid monomers.

In order to obtain a polyester resin as the binder resin, not only a polymer from the above bifunctional monomer but a polymer containing the trifunctional or multifunctional monomer component may also be suitably used. Examples of the trihydric or polyhydric alcohol monomer as such the mulifunctional monomer include sorbitol, 1,2,3,6-hexantetrol, 1,4-sorbitane, pentaerythritol, dipentaerythritol, tripentaerythritol, sugar, 1,2,4-butantriol, 1,2,5-pentantriol, glycerol, 2-methylpropantriol, 2-methylolethane, trimethylolpropane, 1,3,5-trihydroxymethylbenzene, and others.

Examples of the trihydric or polyhydric carboxylic acid monomer include 1,2,4-benzentricarboxylic acid, 1,2,5-benzentricarboxylic acid, 1,2,4-cyclohexantricarboxylic acid, 2,5,7-naphthalentricarboxylic acid, 1,2,4-naphthalentricarboxylic acid, 1,2,4-butantricarboxylic acid, 1,2,5-hexantricarboxylic acid, 1,3-dicarboxyl-2-methyl-2-methylenecarboxypropane, tetra(methylencarboxyl)methane, 1,2,7,8-octantetracarboxylic acid, empol trimeric acids, acid anhydrides of these acids, and others.

The above-mentioned tri- or multifunctional monomer component is desirable to be contained in a proportion of from 5 to 80 mole % in the alcohol or acid component as the structure unit of the polymer.

Other resins which may also be used as the binder resin include, e.g., those polymers or copolymers containing monoolefin-type monomers or diolefin-type monomers. Examples of the monoolefin-type monomer for obtaining such polymers or copolymers include styrenes such as styrene, o-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrene, p-n-nonylstryrene, p-n-decylstyrene, p-n-dodecylstyrene, p-methoxystyrene, p-phenylstyrene, p-chlorostyrene, 3,4-dichlorostyrene, etc.; ethylene-type unsaturated monoolefins such as ethylene, propylenbutylene, isobutylene, etc.; halogenated vinyls such as vinyl chloride, vinylidene chloride, vinyl bromide, vinyl fluoride, etc.; vinyl esters such as vinyl acetate, vinyl propionate, vinyl benzoate, vinyl butyrate, etc.; α-methylene aliphatic monocarboxylic acid esters such as methyl acrylate, ethyl acryltae, n-butyl acrylate, isobutyl acrylate, propyl acrylate, n-octyl acrylate, dodecyl acrylate, lauryl acrylate, 2-ethylhexyl acrylate, searyl acrylate, 2-chloroethyl acrylate, phenyl acrylate, methyl α-chloroacrylate, methyl methacrylate, ethyl methacrylate, propyl methacrylate, n-butyl methacrylate, isobutyl methacrylate, n-octyl methacrylate, dodecyl methacrylate, lauryl methacrylate, 2-ethylhexyl methacrylate stearyl methacrylate, phenyl methacrylate, dimethylaminoethyl methacrylate, diethylaminoethyl methacrylate, etc.; acrylic or methacrylic acid derivatives such as acrylonitrile, methacrylonitrile, acrylamide, etc.; vinyl ethers such as vinyl-methyl ether, vinyl-ethyl ether, vinyl-isobutyl ether, etc.; vinyl ketones such as vinyl-methyl ketone, vinyl-hexyl ketone, methyl-isopropenyl ketone, etc.; N-vinyl compounds such as N-vinyl-pyrrole, N-vinyl-carbazole, N-vinyl-indole, N-vinyl-pyrrolidone, etc.; vinylnaphthalenes; and the like.

Examples of the diolefin-type monomer include propadiene, butadiene, isoprene, chloroprene, pentadiene, hexadiene and the like.

These monoolefin-type monomers or diolefin-type monomers may be used alone or in plural combination or combinedly used to be polymerized to give a copolymer. In this instance, particularly a styrene-acryl copolymer is preferred.

In addition, a cross-linked polymer that can be obtained by the reaction of a cross-linking agent such as divinyl benzene, divinyl naphthalen or the like with the above-mentioned monomer may also be used as the binder resin.

Other resins which may also be used as the binder resin include, e.g., epoxy resins. As the constituent necessary to obtain the epoxy resin, for example, bisphenol A, epichlorohydrine or the like may be used. Of these, especially bis-phenol A-type epoxy resins are suitable.

Examples of the coloring agent to be contained in the toner include carbon black, nigrosine dye (C.I. No. 50415B), aniline blue (C.I. No. 50405), calco oil blue (C.I. No. azoec Blue 3), rhodamine BS (C.I. No. 45170), chrome yellow (C.I. No. 14090), ultramarine blue (C.I. No. 77103), DuPont oil red (C.I. No. 26105), perillen scarlet (C.I. No. 71137), quinoline yellow (C.I. No. 47005), methylene blue chloride (C.I. No. 52015), phthalocyanine blue (C.I. No. 74160), malachite green oxalate (C.I. No. 42000), lump black (C.I. No. 77226), rose-bengal (C.I. No. 45435), and mixtures of these dyes and others. These coloring agents need to be contained in a sufficient proportional amount for the formation of an adequate density-having visible image; the amount is normally within the proportional rnage of from 1 to 20 parts by weight to 100 parts by weight of the binder resin.

The toner may, if necessary, contain various additives such as an antioffset agent and the like.

As the antioffset agent, for example, polyolefin wax, carnauba wax, alkylene-bis-fatty acid amide compounds and the like may be used.

In the present invention, the crrier which constitutes the foregoing toner as well as the developer is prepared in the following manner: Fifty to 90% by weight magnetic material powder are mixed into a binder resin, the mixture is then kneaded with heating, cooled, pulverized and classified and, if necessary, subjected to heat treatment to be made spherical to thereby obtain a carrier having a weight average particle size of 5 to 50 μm and a volume resistivity of $10^{11}\Omega$cm to $10^{15}\Omega$cm. Alternatively, the surface of indeterminate-form or spherical magnetic particles may be coated with a resin by, e.g., the immersion method, spray method, fluidization bed method, or the like, thereby preparing a carrier having the above-mentioned particle size. Usable examples of the binder resin to be applied to the above carrier include acryl resins, styrene resins, styrene-acryl resins, epoxy resins, urethane resins, silicone resins, polyamide resins, polyester resins, acetal resins, polycarbonate resins, phenol resins, vinyl chloride resins, vinyl acetate resins, cellulose resins, polyolefin resins, fluoride-type resins, copolymer resins and mixed resins of these resins, and the like. Of these binder resins, particularly useful ones are styreneacryl resins, silicone resins and fluoride-type resins.

Examples of the magnetic material for use in preparing the carrier include ferromagnetism-showing metals such as iron, cobalt, nickel, etc., or alloys or compounds containing these metals; chromium dioxide; and those called 'ferrite' having the chemical formula $MO:Fe_2O_3$, wherein M represents a bivalent metal such as Cu, Zn, Ni, Mg, Mn, Fe, Co or Pb.

The foregoing weight average particle sizes of the toner and the carrier are the ones that have been measured by means of a Coultercounter, manufactured by Coulter Co. And the foregoing volume resistivity can be found in the manner that sample particles are put in a container having a sectional area of 0.50 $cm^2$ and tapped, then the stuffed sample particles' layer is pressed to be of a thickness of about 1 mm by putting a load of 1 kg/cm$^2$ thereon, and an electric field of 1000 V/cm is applied to between the load and the bottom electrode, and then the value of the electric current flowing at the moment is measured.

Figure 2:
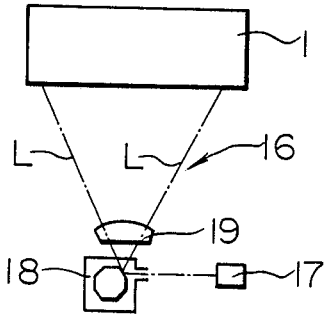
FIG. 2 and FIG. 3 are cross-sectional views of the laser optical system and of the developing device, respectively, to be incorporated into the multicolor image forming apparatus of FIG. 1.
Figure 3:
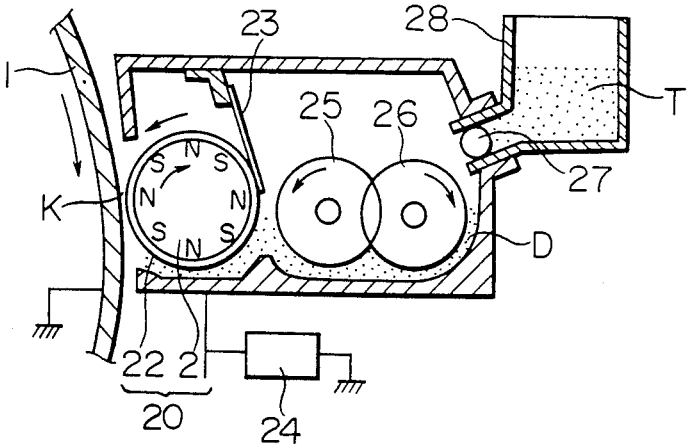

As the developer to be used in this invention, 2 to 30 parts by weight of the toner and 100 parts by weight of the carrier are mixed to be used. The foregoing metal oxide particles are preferably in advance mixed with the toner, but may be added after mixing the above toner containing no metal oxide particles with the carrier. The above developer may contain a fluidizer such as a hydrophobic silica, zinc stearate or the like having a BET specific surface of 100 to 400 m$^2$/g in an amount of from 0.01 to 2.0% by weight. The method for the formation of a multicolor image according to this invention by using a two-component developer of the foregoing composition is as follows:

FIG. 1 through FIG. 3 are drawings for explaining the foregoing method for the formation of a multicolor image, wherein FIG. 1 is a cross-sectional view of a principal part of an example of the apparatus for use in forming a multicolor image, and FIGS. 2 and 3 are cross-sectional views of the principal parts of the laser optical system and non-contact developing device which are to be incorporated into the apparatus of FIG. 1. Indicated with 1 of FIG. 1 is an OPC photoreceptor to be negatively charged, whose upper layer is a carrier transport layer, 2 is a light source, 2' is an interchangeable plural color separation filter (including e.g., blue (B), green (G), red (R), and ND filters), 3 is a reflective mirror, 4 is a lens, 5 is a primary CCD iamge sensor, provided that the 2, 3, 4 and 5 are integrated into one unit to constitute an image input section IN. TR is an image processing section containing an invertor for converting color separation information into complementary colors, 6 is a multicolor original, 7 is a laser optical system, and L is a laser beam coming through laser optical system 7.

Indicated with 8 is a charger for negative charging, 9 is a corona discharger for image transfer, 10 is a separation electrode, 11 is a fixing device, 12 is a charge eliminator to be used prior to cleaning, and 13 is a cleaning device comprised of a cleaning blade 14, fur brush 15 and recovery roller 16.

In the multicolor image forming apparatus of FIG. 1, in order to form a multicolor image comprised of four colors—yellow (Y), magenta (M), cyan (CY) and black (BK), four non-contact reversal developing devices A for Y toner development, B for M toner development, C for Cy toner development and D for BK toner development are arranged (the devices will be detailed hereinafter). Herein, each of the Y, M, C and BK toners contains the foregoing metal oxide particles in an amount of from 0.2 to 2% by weight, and preferably from 0.2 to 1.0% by weight to the toner, so that a satisfactory image transfer free from any transfer faults such as transfer marks, transfer-off spots, etc., can be attained even if no exposure prior to the transfer is performed.

The foregoing image input section IN is moved in the direction of arrow X by a driving means (not shown) to thereby let the foregoing CCD image sensor 5 read color separation information according to each of the B, G, R and ND filters, and convert the information into an electric signal. The electric signal is then further converted at the processing section TR into data in the suitable form for recording. Laser optical system 7, according to the above image data, forms an electrostatic latent image on image carrier 1 in the following manner: The surface of image carrier 1 (e.g., OPC photoreceptor) is overall negatively charged uniformly by means of a scorotron charger 8, and subsequently the surface of image carrier 1 is imagewise exposed through the lens to original limit light L, and thus an electrostatic latent image corresponding to the original is formed on image carrier 1.

This electrostatic latent image is first developed by developing device A containing the yellow (Y) toner. The image carrier 1 bearing the toner image formed by the yellow (Y) toner, after the subsequent rotation of the image carrier, is again uniformly charged by scorotron charger 8 and then again imagewise exposed to original image light L according to different color component-recorded data. The electrostatic latent image formed this time is then developed by developing device B containing the magenta (M) toner.

As a result, on image carrier 1 is formed a two-color toner image according to the yellow (Y) toner and the magenta (M) toner. Subsequently, in the same manner as in the above, a toner image by the cyan (Cy) toner and a toner image by the black (BK) toner are superposed in order upon the above two-color image in four revolutions of the image carrier, whereby four-color toner image is formed on image carrier 1. Each of the developing devices A, B, C and D are of the same construction as that of the developing device of FIG. 3.

The thus obtained multicolor toner image is then transferred by transfer electrode 9 onto a copying sheet of paper P. The copying sheet of paper P is separated by separation electrode 10 from image carrier 1, and then fixed by fixing device 11, and thus a fixed image is formed. On the other hand, image carrier 1 is subjected to charge elimination treatment by means of charge eliminator electrode 12, and then have the surface thereof cleared out by cleaning device 13. The cleaning device 13 in this example has cleaning blade 14, fur brush 15 and toner recovery roller 16. These means are kept non-contact with image carrier 1 while the image formation is making progress. Upon completion of the final multicolor toner image formation on image carrier 1, both cleaning blade 14 and fur brush 15 are bought into contact with image carrier 1, and scrape off the residual toner on image carrier 1 after the transfer of the toner image. After that, cleaning blade 14 leaves image carrier 1, and then a little later fur brush 15 leaves the image carrier. Fur brush 15 functions to clear out the residual toner on image carrier 1 at the time when cleaning blade 14 leaves the image carrier. Indicated with 16 is a roller for collecting the toner scraped off by blade 14.

An example of the laser optical system 7 is shown in FIG. 2, wherein 17 is a laser diode, 18 is a polygon mirror, and 19 is a f$\theta$ lens.

In such the image forming apparatus, for the registering of the respective color images, it is desirable that optical markings be put on image carrier 1 to let the optical sensor read to thereby enable the timely initiation of exposure.

The construction of the non-contact developing device to be incorporated into the foregoing multicolor image forming apparatus will now be explained in accordance with FIG. 3. In the drawing, 20 is a developing roller, 21 is a magnetic roller having eight N,S alternate magnetic poles rotatable in the direction of arrow, and 22 is a sleeve which is to rotate in the direction inverse to that of magnetic roller 21 to transport the developer layer to developing region K. The strength of the magnetic pole (magnetic flux density) in the developing region is from 500 to 1500 gauss, and the magnetic roller is allowed either to rotate in the same direction as sleeve 22 or to be fixed. Sleeve 22 is desirable to be one made of a non-magnetic material such as aluminum, brass or the like. The surface of the sleeve may, if necessary, be roughened by sand blast treatment or the like, and also, if necessary, be highly resistant. The number of the magnetic poles may be arbitrarily selected in the range of from 4 to 20 poles, but from the standpoint of transporting the developer uniformly, the number of poles is preferred to be 6 or more poles. Indicated with 23 is a layer thickness regulating member for regulating the developer layer thickness, which may be a magnetic or nonmagnetic plate or a rotary body to form a revolving magnetic field, arranged closely to sleeve 22. As the regulating member, preferably an elastic plate which, with a pressure force of 0.2 to 5 g/cm, presses sleeve 22 is used, and this is considered suitable for the formation of a developer layer as much thin as about 20 to 500 μm, which is desired in accomplishing the non-contact development by using a two-component developer. And in the developing region K, the gap between image carrier 1 that rotates in the direction of arrow and sleeve 22 is larger than the thickness of the developer layer and is normally free from 100 to 1000 μm, and it is thus settled so as to enable the non-contact development under the condition of an oscillating electric field. Indicated with 24 is an AC bias power supply for the purpose of forming the foregoing oscillating electric field, whose frequency is normally from 100 Hz to 10 kHz, and preferably from 1 to 5 kHz, and to the power supply is applied a bias voltage of 0.2 to 3.0 KV(P-P), and preferably 1.0 to 2.9 KV(P-P). Further, in order to get rid of a fog, in the case of the normal development, a DC bias voltage of 50 to 500 V of the same polarity as the electrostatic latent image is superposedly impressed, while in the case of the reversal development C, a DC bias voltage near to the latent image's electric potential is impressed. Indicated with 25 and 26 are stirring devices which are rotatable in the respective directions of arrows, and their shafts each is provided with a plurality of oblique stirring blades, and the respective stirring blades are designed so as not to strike against one another but to be rotatable overlappingly in the same region. Therefore, the developer is stirred to be moved in the same direction as the rotating axis and also in the direction perpendicular to the axis, whereby the frictional charging and uniform mixing of the developer can be adequately accomplished. Indicated with 27 is a toner replenishing roller, 28 is a toner hopper, and T is a replenishing toner.

The image forming method of this invention has been explained above by making reference to the multicolor image forming apparatus of FIG. 1, the laser optical system of FIG. 2, and the developing device of FIG. 3, but this is nothing else but an example.

For example, the multicolor image forming apparatus of FIG. 1 uses as its light source a laser light modulated according to digitized color signals, but may be an analog-type multicolor image forming apparatus wherein, for example, the color-separated lights from a multicolor original (separated by B, G, R and ND filters) are used as light sources, and development is made with complementary color toners such as Y, M, C and BK toners. Also the multicolor image forming apparatus of FIG. 1 uses a single exposure device in common for making four different color toner images by four revolutions of the image carrier, and after the black toner image formation in the fourth revolution of the image carrier, the whole toners' image is transferred at a time onto a copying material to thereby form a multicolor image, but may instead be so designed as to be provided with the number of exposure devices corresponding to the number of color separation lights so that a multicolor toner image can be formed on the image carrier in a single revolution thereof and the image transfer and cleaning of the image carrier thereafter can be performed.

In addition, in forming a multicolor toner image by superposing different color toner images upon the image carrier, the respective color toner images may be formed to be laid out without overlapping one another in the same region, or the respective color toner images may overlap but the picture elements (or image dots) donot overlap or at least partly overlap—any of these instances may be allowed.

The multicolor image forming apparatus in FIG. 1 is regarded as for the image forming method according to the Carlson process, but may be for the image forming method of the NP type. And the image carrier that is incorporated in the apparatus of FIG. 1 comprises an OPC photoreceptor, but any image carriers of all types of photoreceptor, dielectric, etc., for use in general electrophotographic recording, including specially hard photoreceptors such as, for example, amorphous silicon photoreceptor, may apply to the image carrier.

EXAMPLES

The present invention will be illustrated further in detail according to the following examples, but the embodiment of the invention is not restricted to and by the examples.

EXAMPLE-1

In this example, the image forming apparatus of FIG. 1, which comprises the laser optical system of FIG. 2, the non-contact developing device of FIG. 3, and a negatively chargeable double-layered organic photoreceptor having a carrier generating layer containing a bisazo pigment, was used to examine by measuring the transfer degrees of the respective color patch toner images formed on the image carrier corresponding to the colors of a color patch original, to examine by measuring the transfer ratio of the multicolor toner image formed on the image carrier by superposing the respective color toner images thereupon corresponding to the colors of a multicolor original, and to evaluate the resulting fixed images thus formed. The image forming manner that has taken place in making the above tests is as has been explained earlier; i.e., an original 6 was color-separated by color separation filter 2' into B, G or R, which was then converted by photoelectric convertor 5 into an electric signal, the obtained electric signal was separated through image processing device TR into Y,M,Cy or BK, then the obtained color signal was conducted into the laser optical system to thereby make laser beam modulation, and the thus obtained modulated beam was made incident upon the image carrier to thereby form an electrostatic latent image thereon. This latent image was subjected to reversal development by the non-contact method by means of the developing device of FIG. 3, and the obtained toner image as electrostatically transferred onto a copying material. In the evaluation, the above transferred toner image was fixed by a heat roller.

The detailed image forming conditions under which the foregoing tests were made for this example are as given in Table 1. The developer that was used in the above tests is as follows:

| | | |
|---|---|---|
| Carrier: | One μm-thick styrene-acryl (1:1) resin-coated core material comprised of copper-zinc-type ferrite particles having an average particle size of 40 μm, a true density of 4.80 g/cm$^3$, a magnetization of 80 emu/cm$^3$ and a volume resistivity of $5 \times 10^9$ Ωcm. | |
| Toner | Polyester resin [UXK-120p] (produced by Kao Co.) | 100 parts bt wt |
| | Polypropylene [Biscol 660P] (produced by Sanyo Chemical Industry Co.) | 4 parts by wt |
| | Carbon black [Mogal L] (produced by Cabot Co.) | 10 parts by wt |

The above constituents were mixed by a Henschel mixer, sufficiently kneaded by a three-roller kneader at 140° C., cooled by air, roughly pulverized and then finely pulverized by a jet mill, and after that classified to thereby obtain a black (BK) toner particles having an average particle size of 11 μm. Also, in the same manner except that the carbon black was replaced by quinoline yellow, rhodamine BS, and phthalocyanine blue as the coloring agent, yellow (Y)-colored particles, magenta (M)-colored particles and cyan (C)-colored particles, respectively, were obtained. Each amount of these four colored particles was divided into 12 parts, of which to the 5 parts was added the additive under the conditions as shown in Table 2, and thus 20 different toners in all were prepared. To the remaining 7 parts was added the additive under the conditions as shown in Table 3, and thus 28 different toners in all for comparative test use were obtained.

Developer:

The thus obtained 20 different toners for this invention's test use and 28 different toners for comparative test use were each used in an amount of 7 parts by weight to be mixed with 100 parts by weight of carrier, whereby 20 different developers for this invention's test use and 28 different developers for comparative test use were obtained.

Figure 4:
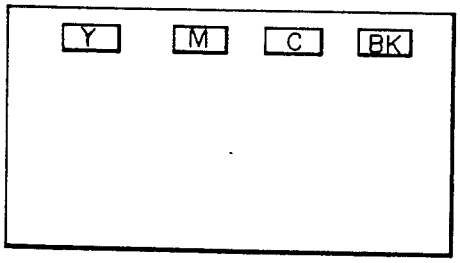
FIG. 4 is a drawing showing a color patch chart.

These developers were loaded in order, according to the Test No. of Table 3, into the developing devices A (for Y toner), B (for M toner), C (for Cy toner) and D (for BK toner). The 'writing' onto image carrier 1 was made in the manner that the chart bearing four color patch solid images (2×5 cm square each) of Y, M, Cy and BK as shown in FIG. 4 was used as an original, and exposure was made with color patch selection in such a way as the Y color patch for the Y toner, the M color patch for the M toner, and so forth, thus forming a corresponding electrostatic latent image on the image carrier by using one corresponding developing device out of the foregoing developing devices A, B, C and D.

In the testing at this time, each of the patch toner images, which thus has been obtained in the above, was measured with respect to the transfer degrees thereof obtained in the cases where the transfer was made in two revolutions (one idle revolution after the patch toner image formation), where the transfer was made in three revolutions (two idle revolutions after the patch toner image formation) and where the transfer was made in four revelations (three idle revolutions after the patch toner image formation). The results obtained are as given in Table 2 and Table 3.

The transfer degree of the patch toner image was measured in the following manner. Incidentally, the term 'transfer ratio' herein implies the ratio in amount of the toner transferred by the electrostatic transfer process from the toner of an image developed on the image carrier, and its measurement is made in accordance with the following steps:

(1) 5 cm×2 cm-size Y, M, C and BK color patches are prepared a originals for the image forming apparatus of FIG. 1, and the lantent image of each of the patches is formed on the image carrier. And the reversal developing of the formed image is performed under the condition of an each image's surface potential of 50 V with a developing bias voltage of DC 500 V applied thereto.

(2) The toner formed on the image carrier is taken up by an adhesive tape, from which the amount of the developing toner $W_1$ is found.

(3) Subsequently, the toner formed by developing under the same condition as in (1) is transferred onto a copying sheet of paper [U-Bix paper 55 kg] for electrophotographic apparatus use to let the residual toner remain on the image carrier. The environment condition at the moment is to be settled to 20° C./60%RH.

(4) The residual toner is taken up by an adhesive tape, from which the amount of the residual toner $W_2$ is found.

The transfer ratio can be found and defined by the following formula:

$$\text{Transfer ratio} = \frac{W_1 - W_2}{W_1} \times 100\ (\%)$$

The voltage to be applied to Transfer Corotron U at the time of the above electrostatic transfer is +6.5 KV, and the amount of the electric current to flow through the tungsten wire used as an electrode is 400 μA.

Figure 6:
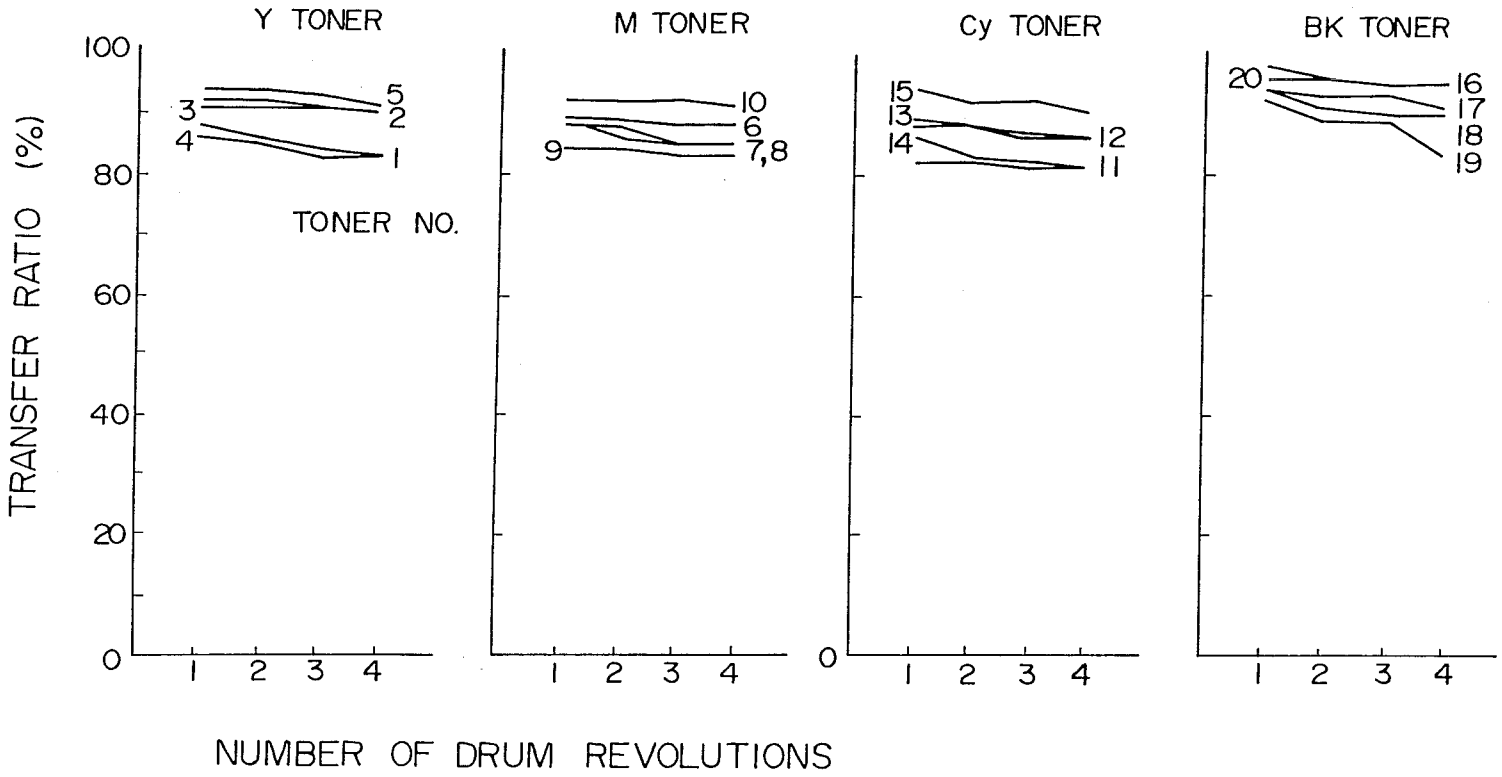
FIG. 6 and FIG. 7 are graphs showing various toner images' transfer degrees in precentage in Example-1.
Figure 7:
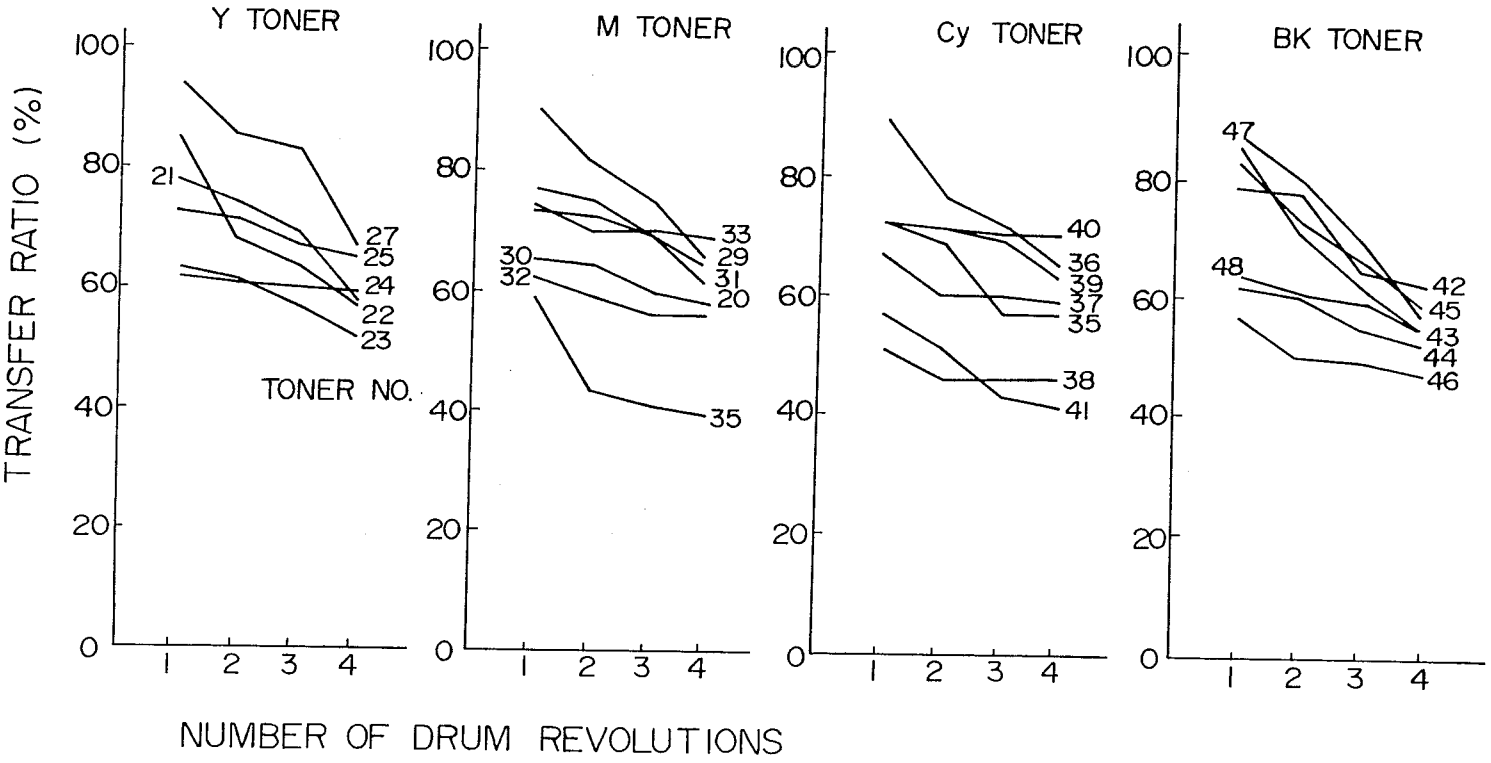

In addition, FIG. 6 is of graphs showing the transfer ratios of the respective color toners for this invention as given in Table 2, while FIG. 7 is of graphs showing the transfer ratios of the respective comparative color toners as given in Table 2.

Next, the image evaluation test of the multicolor image obtained by transferring and fixing the superposed toner image formed from the multicolor original took place in the following manner:

As in the case of the foregoing patch original, four different color particles of Y, M, Cy and BK were prepared, and each amount of these color particles was divided into 8 parts, and to these parts was added the additive under the conditions as shown in Table 4, whereby 16 different toners for this invention's test use and 16 different toners for comparative test use were obtained. Subsequently, 7 parts by weight of each of these toners and 100 parts by weight of the carrier that was obtained in the same manner as in the foregoing color patch original were mixed, whereby 16 different developers for this invention's test use and 16 different developers for comparative test use were obtained. These developers were loaded according to the test No. of Table 4 into the appropriate color developing devices A, B, C and D, and, according to the image forming conditions of Table 1 and making four revolutions of image carrier 1, the imagewise exposure and the non-contact developing of each of Y, M, C and BK were repeated each time when one revolution of the image carrier is made, and in this manner, each multicolor toner image formed by superposing the respective color toner images on the foregoing image was electrostatically transferred by transfer electrode 9 onto a copying sheet of paper P, and the sheet of paper was separated by separation electrode 10 from the image carrier, and then fixed by heat roller fixing device 11, whereby a multicolor image was finally formed. The surface of image carrier 1 after the transfer was cleaned by cleaning device 13 thereby to be ready for the subsequent image formation. The above image forming process was repeated 1000 times for each test No. to make copies of the multicolor image, and collective evaluation on the items of image quality, fog, density marks and image density was made for each test No. in the manner of visual judgment to classify the results into three grades A for good, B for poor and C for not good. The evaluated results are as shown in Table 4.

Further, aside from the above, 16 different developers for the invention's test use and 16 different developers for comparative test use were prepared in the same manner as in the case of the above evaluation of the image from the multicolor original, and the transfer ratio of the superposed toner image was measured. In this instance, the measurement of the transfer ratio was made in accordance with the transfer ratio measuring method that was performed in the foregoing transfer test for each separate color toner image, but a black patch was used as an original, and laser-light exposure corresponding to the original was repeated four times to thereby form a multicolor toner image, and then the multicolor toner image was measured with respect to the transfer degree thereof.

That is, a 5×2 cm-size black patch was prepared. The image carrier was in advance charged uniformly, and then exposed to the laser beam corresponding to the patch to thereby form an electrostatic latent image on the image carrier. This was then developed first by the Y toner to form a Y toner image, and then again repeatedly charged, exposed and developed likewise by the M toner, Cy toner and BK toner to thereby superposedly form M toner image, Cy toner image and BK patch toner image in the described order upon the above Y toner image. At this time, the surface potential of the exposed portion, i.e., latent image section, was −50 V, and the DC bias voltage for reversal development was −500 V.

The above-formed patch image (black), constituted by four color toners, was measured with respect to the transfer ratio thereof according to the transfer ratio measuring method that took place in the case of the foregoing transfer test for each separate color image. The obtained results are as shown in Table 4.

TABLE 1

- Image carrier: 140 mm-diameter drum-type photoreceptor having a photosensitive layer comprising a carrier-generating layer containing an azo pigment.
- Line speed: 60 mm/s
  Surface potential: −700 V (non-image area) to −50 V image area)
- Exposure light source: Ga-Al-As laser diode (wavelength: 780 nm, recording density: 16 dots/mm)
- Construction of developing devices A–D:
  Diameter of developing sleeve: 20 mm
  Line speed of developing sleeve: 250 mm/s (in the normal direction)
  Number of poles of magnetic roller: 8 poles
  Revolving speed of magnetic roller: 800 rpm
  Thin layer forming member: 1 mm-thick elastic plate made of polyurethane is elastically arranged so as to press with a pressing force of 2 g/cm on the developing sleeve.
  Developing gap: 0.3 mm (gap between the image carrier and the sleeve in the developing region)
  Maximum magnetic flux density on the surface of the sleeve: 700 gauss
  Thickness of the developer layer: 200 μm (max)
  Toner content of the developer layer formed on the developing sleeve: 0.4 mg/cm$^2$
  DC bias voltage at the time of development: −500 V
  AC bias voltage at the time of development: 1.2 KV (peak-to-peak), frequency: 2 KHz
  DC bias voltage when not in developing: 0 V
  AC bias voltage when not in developing: 0.3 kV or more (peak-to-peak), frequency: 2 kHz peak.
  (The magnetic roll and developing sleeve stand still when not in developing. The developing sleeve may be electrically put in the state of floating.)
- Type of developing process: Non-contact reversal development
  In the case of multicolor developing to form multicolor image:
- Developing order: (yellow) → (magenta) → (cyan) → (black)
- Transfer process: Corona discharge process
- Fixing process: Heat roller fixing process
- Cleaning process: Blade and fur brush

TABLE 2

| | | | Characteristics | | | | | | |
|---|---|---|---|---|---|---|---|---|---|
| | | | Additive (mtal oxide particles) | | | Transfer ratio % | | | |
| Toner test No. | | | Kind | Specific surface m$^2$/g | Added amount % by wt | First revolution | Second revolution | Third revolution | Fourth revolution |
| FOR INVENTION | Y Toner | 1 | $TiO_2$ | 31 | 1.0 | 88 | 86 | 84 | 83 |
| | | 2 | " | 50 | 1.0 | 92 | 92 | 91 | 90 |
| | | 3 | " | 58 | 1.0 | 91 | 91 | 91 | 90 |
| | | 4 | " | 50 | 0.3 | 86 | 85 | 83 | 83 |
| | | 5 | " | 50 | 1.8 | 94 | 94 | 92 | 91 |
| | M Toner | 6 | $SiO_2$ | 31 | 1.0 | 89 | 89 | 88 | 88 |
| | | 7 | " | 50 | 1.0 | 88 | 88 | 85 | 85 |
| | | 8 | " | 58 | 1.0 | 88 | 86 | 85 | 85 |
| | | 9 | " | 50 | 0.3 | 84 | 84 | 83 | 83 |
| | | 10 | " | 50 | 1.8 | 92 | 92 | 92 | 91 |
| | C Toner | 11 | $TiO_2$ | 31 | 1.0 | 82 | 81 | 81 | 81 |
| | | 12 | " | 50 | 1.0 | 88 | 88 | 87 | 86 |
| | | 13 | " | 58 | 1.0 | 92 | 88 | 86 | 86 |
| | | 14 | " | 50 | 0.3 | 86 | 83 | 82 | 81 |
| | | 15 | " | 50 | 1.8 | 94 | 92 | 92 | 90 |
| | BK Toner | 16 | $SiO_2$ | 31 | 1.0 | 98 | 96 | 95 | 95 |
| | | 17 | " | 50 | 1.0 | 94 | 93 | 93 | 91 |
| | | 18 | " | 58 | 1.0 | 94 | 91 | 90 | 90 |
| | | 19 | " | 50 | 0.3 | 92 | 89 | 89 | 83 |
| | | 20 | " | 50 | 1.8 | 96 | 96 | 95 | 95 |

TABLE 3

| Toner test No. | | | Characteristics: Additive (mtal oxide particles) Kind | Specific surface $m^2/g$ | Added amount % by wt | Transfer ratio %: First revolution | Second revolution | Third revolution | Fourth revolution |
|---|---|---|---|---|---|---|---|---|---|
| FOR COM-PARA-TIVE | Y Toner | 21 | $TiO_2$ | 29 | 1.0 | 78 | 74 | 69 | 58 |
| | | 22 | " | 62 | 1.0 | 85 | 68 | 64 | 57 |
| | | 23 | " | 50 | 0.1 | 63 | 61 | 57 | 52 |
| | | 24 | " | 50 | 2.3 | 62 | 61 | 60 | 59 |
| | | 25 | " | 29 | 0.15 | 72 | 71 | 67 | 65 |
| | | 26 | " | 62 | 2.2 | 94 | 85 | 83 | 67 |
| | | 27 | " | — | — | 56 | 52 | 46 | 40 |
| | M Toner | 28 | $SiO_2$ | 29 | 1.0 | 73 | 72 | 69 | 61 |
| | | 29 | " | 62 | 1.0 | 90 | 81 | 75 | 65 |
| | | 30 | " | 50 | 0.1 | 65 | 64 | 60 | 58 |
| | | 31 | " | 50 | 2.3 | 77 | 75 | 70 | 64 |
| | | 32 | " | 29 | 0.15 | 62 | 59 | 56 | 56 |
| | | 33 | " | 62 | 2.2 | 74 | 70 | 70 | 69 |
| | | 34 | — | — | — | 59 | 43 | 41 | 39 |
| | C Toner | 35 | $TiO_2$ | 29 | 1.0 | 72 | 69 | 57 | 57 |
| | | 36 | " | 62 | 1.0 | 89 | 77 | 72 | 65 |
| | | 37 | " | 50 | 0.1 | 67 | 60 | 60 | 59 |
| | | 38 | " | 50 | 2.3 | 72 | 71 | 69 | 63 |
| | | 39 | " | 29 | 0.15 | 51 | 46 | 46 | 45 |
| | | 40 | " | 62 | 2.2 | 73 | 71 | 70 | 70 |
| | | 41 | — | — | — | 57 | 51 | 43 | 41 |
| | BK Toner | 42 | $SiO_2$ | 29 | 1.0 | 78 | 77 | 64 | 62 |
| | | 43 | " | 62 | 1.0 | 85 | 71 | 62 | 54 |
| | | 44 | " | 50 | 0.1 | 62 | 60 | 55 | 52 |
| | | 45 | " | 50 | 2.3 | 87 | 80 | 69 | 57 |
| | | 46 | " | 29 | 0.15 | 57 | 50 | 49 | 47 |
| | | 47 | " | 62 | 2.2 | 82 | 73 | 66 | 58 |
| | | 48 | " | — | — | 64 | 61 | 59 | 54 |

TABLE 4

| Test No. | | Characteristics: Additive (metal oxide particles) Y toner Kind | Y toner Specific surface $m^2/g$ | Y toner Added amount % by wt | M toner Specific surface $m^2/g$ | M toner Added amount % by wt | C toner Specific surface $m^2/g$ | C toner Added amount % by wt | BK toner Specific surface $m^2/g$ | BK toner Added amount % by wt | Transfer ratio (%) | Image quality |
|---|---|---|---|---|---|---|---|---|---|---|---|---|
| Invention | 49 | $TiO_2$ | 40 | 1.0 | 40 | 1.0 | 40 | 1.0 | 40 | 1.0 | 93 | A |
| | 50 | " | " | " | " | " | " | " | — | — | 92 | A |
| | 51 | $SiO_2$ | " | " | " | " | — | — | — | — | 87 | A |
| | 52 | " | " | " | — | — | — | — | — | — | 85 | A |
| Comparative | 53 | $TiO_2$ | 29 | 0.1 | 29 | 0.1 | 29 | 0.1 | 29 | 0.1 | 58 | C |
| | 54 | $SiO_2$ | 61 | 2.1 | 61 | 2.1 | 61 | 2.1 | 61 | 2.1 | 63 | C |
| | 55 | " | 29 | 0.1 | 40 | 0.1 | 40 | 1.0 | 40 | 1.0 | 57 | C |
| | 56 | — | — | — | — | — | — | — | — | — | 53 | C |

From Table 2, Table 3, FIG. 6 and FIG. 7 it is apparent that where the color toners of this invention are used, no transfer troubles occur even when the transfer is made after three or four revolutions of the image carrier, whereas where the comparative toners are used, irregular transfer and transfer-off spots appear from around the third revolution of the image carrier. It is also apparent from Table 4 that where multicolor images are formed by using the toners of this invention at least in the initial development, no transfer troubles occur, so that the resulting images are excellent, whereas the comparative toners are used at least in the initial development, irregular transfer and transfer-off spots appear to deteriorate the quality of the resulting images.

EXAMPLE-2

In this example, the multicolor image forming apparatus described in Example-1 was used to superposedly form a multicolor toner image on an image carrier in accordance with the following image forming method, and then the transfer ratio measuring test of the formed image and the evaluation of the image after fixing were performed.

The above-mentioned test took place according to the following image forming method:

The optical information from an original 6 was color-separated into red (R) and cyan (Cy) by using a dichroic mirror in place of the color separation filter, which were then photoelectrically converted by CCD image sensor S into R and Cy electric signals. The R and Cy electric signals were then color-separated by image processor TR to produce blue, red and black color signals. By these color signals, the laser beam from the laser optical system having the construction shown in FIG. 2 was modulated, and the thus modulated laser beam L was written on the image carrier 1 comprised of a negatively chargeable organic photoreceptor to thereby form an electrostatic latent image thereon. The writing onto the foregoing image carrier 1, after being subjected to uniform charging by charger 8 in the first revolution of the image carrier 1, was exposed to the laser beam LB modulated by the blue signal to thereby form an electrostatic latent image, which was then subjected to non-contact reversal development by means of developing device B containing a blue toner developer, whereby a blue toner image was formed.

The image carrier 1 carrying this blue toner, in the state of being released from treatment such as cleaning, was again charged in the second revolution thereof, and was then exposed to the laser beam LR modulated by the red signal to thereby form an electrostatic latent image, which was then subjected to non-contact reversal development by means of developing device A containing a red toner developer, whereby a red toner imaged was superposedly formed upon the above-mentioned blue toner image. Further, in like manner, in the third revolution of the image carrier, by way of the exposure to the laser beam LBK modulated by the black signal and development by developing device C containing a black toner developer, a black toner image was superposedly formed upon the foregoing blue toner image and red toner image, and thus a multicolor toner image was obtained.

Regarding the color toners in the color developers that were used in the foregoing image forming method, the cyan toner (used as a blue toner) and black toner are ones of Example 1, while the red toner is one using Perillen Scarlet as its coloring agent, and to each of all these toners was added 1.0% weight an additive $TiO_2$ having a specific surface of 50 $m^2/g$.

As a comparative example, the image formation in the same manner but without adding the above additive was also tested.

The multicolor toner image thus obtained in the above manner was electrostatically transferred by means of transfer electrode 9 onto a copying sheet of paper P and then thermally fixed by means of heat roller fixing device 11, whereby a final multicolor image was formed. The image carrier 1 after the transfer was cleared out by cleaning device 13 thereby to be ready for the subsequent image formation.

The conditions in detail, under which the above image formation took place, is similar to those described in Table 1 in Example-1, but differ in the color developing order in the multicolor image formation; the order in this example is: Blue→red→black.

All copies of the image obtained when consecutively repeating the foregoing image forming process 1000 times were of an excellently high-quality, clear image showing almost no transfer troubles such as transfer-off spots. In contrast, in the comparative example, troubles such as repellency spots, transfer-off spots, etc., appeared from the first copy on. The transfer degree in the 1000th copy was as excellent as 89%.

Further, in the case where the foregoing $TiO_2$ was replaced by each of aluminum oxide having a specific surface of 50 $m^2/g$, zinc oxide having a specific surface of 45 $m^2/g$, tin oxide having a specific surface of 40 $m^2/g$, calcium oxide having a specific surface of 45 $m^2/g$, strontium oxide having a specific surface of 60 $m^2/g$, cerium oxide having a specific surface of 30 $m^2/g$, chromium oxide having a specific surface of 60 $m^2/g$, nickel oxide having a specific surface of 50 $m^2/g$, iron oxide having a specific surface of 60 $m^2/g$, and zirconium oxide having a specific surface of 45 $m^2/g$, more satisfactory image copies than in the comparative example can be obtained, showing its effect against such troubles as repellency spots, transfer-off spots, even when repeating the foregoing image forming process 100 times.

EXAMPLE-3

Figure 5:
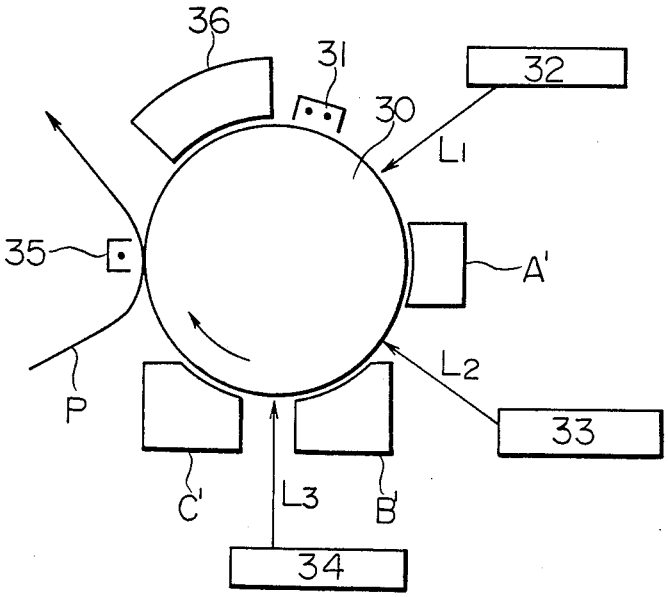
FIG. 5 is a cross-sectional view of another example of the multicolor image forming apparatus applicable to this invention.

FIG. 5 is a drawing for explaining this example, which is different from Example-1 in that a laser optical system which writes according to the yellow (Y), magenta (M) or cyan (Cy) color signal is provided for each of the developing devices containing Y, M and Cy developers, and in only one revolution of the image carrier, the formation of a multicolor toner image, the transfer of the multicolor toner image, and the cleaning of the image carrier surface after the transfer are performed.

In FIG. 5, indicated with 30 is a negatively chargeable organic photoreceptor comprising a carrier generating layer containing a $\tau$-type phthalocyanine, 31 is a corona discharger, P is a copying sheet of paper, 32, 33 and 34 are laser optical systems which are to be modulated by Y, M and Cy color signals, respectively, $L_1$, $L_2$ and $L_3$ are laser beams from the above laser optical systems to be made incident upon an image carrier 30, 35 is a transfer electrode and 36 is a cleaning device.

In order to form a multicolor image by using the apparatus of FIG. 5, an optical information that has been obtained by light-scanning a multicolor original was separated through B, G and R filters into three colors, which were then photoelectrically converted into electric signals. The obtained electric signals were converted into Y, M and Cy color signals by means of an inverter for complementary color conversion and image processor, and these color signals were stored in a memory. In the first timing, the Y signal was produced from the memory to modulate the appropriate laser optical system to emit a modulated beam $L_1$ to have the in advance uniformely charged image carrier 30 imagewise exposed thereto, whereby an electrostatic latent image was formed. This latent image is then subjected to non-contact reversal development by developing device A′ containing Y toner developer, whereby a Y toner image was formed.

In the subsequent timing, the M color signal was produced from the memory, and in like manner, the image carrier was imagewise exposed to beam $L^2$ through laser optical system 33 and then developed by developing device B′, whereby a M toner image was superposedly formed upon the foregoing Y toner image.

Further, in the third timing, the Cy color signal was produced from the memory, and by way of imagewise exposure to beam $L^3$ from laser optical system 34 and development by developing device C′, a Cy color toner image was superposedly formed upon the foregoing Y toner image and M toner image, and thus a multicolor toner image was obtained. This multicolor toner image was transferred electrostatically at a time by transfer electrode 35 onto a copying sheet of paper P. The image carrier 30 after the transfer was cleared out by cleaning device 36 thereby to be ready for the subsequent image formation.

In the above instance, the foregoing charger 31, developing devices A′, B′ and C′, transfer electrode 35 and cleaning device 36 can be the same in the construction as those used in Example-1, and as the Y toner, M toner and Cy toner, the corresponding toners in Example-1 can be utilized, provided tht the metal oxide particles to be added to each toner are $SiO_2$ particles having a BET specific surface of 40 $m^2/g$, which particles are incorporated in an amount of 0.60 % by weight in the toner. And as the carrier, a carrier having an average particle size of 40 μm prepared by dispersing 60 parts by weight of magnetite power having an average particle size of 0.1 μm and having a magnetization strength of 80 emu/cm$^3$ into 100 parts by weight of a styrene-acryl (1:1) resin was used. The image formation was made according to the testing conditions as given in Table 5.

TABLE 5

- Image carrier: A 140 mm-diameter drum-type photoreceptor having a photosensitive layer containing-type phthalocyanine in its carrier generating layer.
  Line speed: 60 mm/s
  Surface potential: −700 V (non-image area) to −50 V (image area)
- Exposure light source: Laser diode (wavelength: 780 mm, recording density: 16 dots/mm)
- Constructions of developing devices A'-C':
  Diameter of developing sleeve: 20 mm
  Line speed of developing sleeve: 250 mm/s (normal direction)
  Number of magnetic poles of magnetic roller: 8 poles
  Revolving speed of magnetic roller: 800 rpm
  Thin layer forming member: 1 mm-thick elastic plate made of polyurethane, elastically arranged to press with a pressing force of 2 g/cm on the surface of developing sleeve.
  Developing gap: 0.3 mm (gap between the image carrier and the sleeve in the developing region)
  The maximum magnetic flux density on the surface of developing sleeve: 700 gauss
  Thickness of developing layer: 200 μm (max)
  Toner content of the developer layer formed on the developing sleeve: 0.4 mg/cm$^2$
  DC bias voltage in developing: −500 V
  AC bias voltage in developing: 1.2 KV (peak-to-peak value, frequency: 2 kHz)
  DC bias voltage when not in developing: 0 V
  AC bias voltage when not in developing: 0.3 KV or more (peak-to-peak value, frequency: 2 kHz)
  (When not in developing, the magnetic roller and developing sleeve stand still. The developing sleeve may be put in the floating state.
- Developing process: Non-contact reversal developing (using a negatively chargeable toner)
- Developing order: (yellow) → (magenta) → (cyan)
- Transfer process: Corona discharging process
- Fixing process: Thermally fixing by a heat roller
- Cleaning process: Blade and fur brush As a result of the 1000-time copying test run according to the image forming conditions of Table 5, high-quality image copies were obtained with no transfer troubles. And when a similar copying test was made also in the case where no metal oxide particles were added to the foregoing developers, the transferred toner image density was reduced by half of the transferred toner image formed by the foregoing developers containing the metal oxide particles, and produced troubles such as irregular transfer and transfer-off spots.

Figure 8:
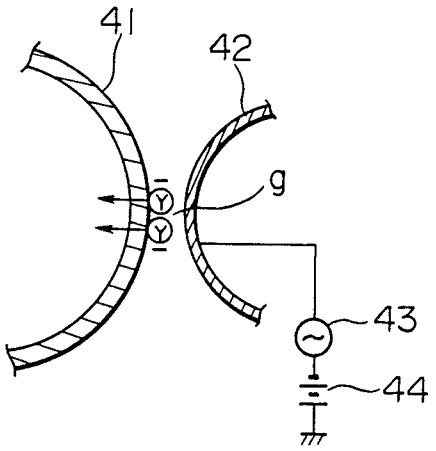
FIG. 8 and FIG. 9 are explanator drawings for the reason of improving the transfer degree in Example-3.
Figure 9:
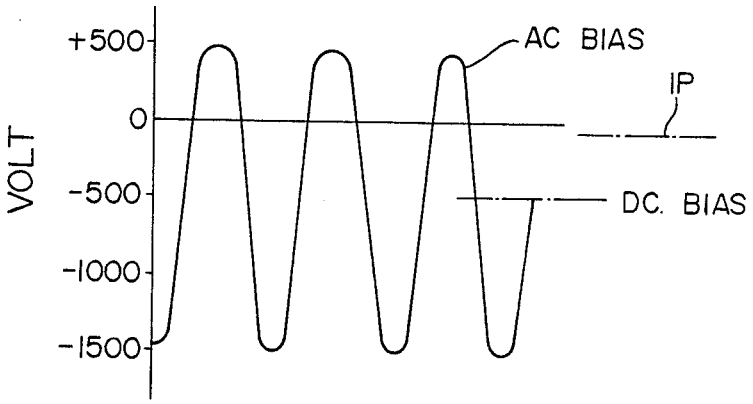

Incidentally, in the present example, the Y toner image, M toner image and BK toner image are formed on the image carrier and transferred onto a copying sheet of paper while in one revolution of the image carrier; that is, the M toner image and BK toner image are formed almost immediately after the formation of the Y toner image and then transferred. Therefore, it is liable to be considered that the increase with time in the adsorption force due to the Y toner image's Van der Waals force and image force, which have affected between the image carrier and the Y toner, is so small that the transfer degree will hardly be deteriorated. However, even in the case of such the image formation, as is apparent from this example, if the developer of this invention is not used, the transfer ratio is deteriorated. The reason is assumed as follows: For example, the initially developed Y toner image, in developing to form the subsequent M toner image, is subject to the influence of the alternating electric field due to the DC bias voltage of FIG. 8 and FIG. 9 in the developing gap of FIG. 8. In FIG. 8, 41 is the image carrying member, 42 is the sleeve of developing roller, 43 and 44 are −2 KV AC and −500V DC bias power sources, respectively and g represents the developing gap. The above alternating electric field oscillates to both positive and negative sides on the basis of, e.g., −500 V, but, as is apparent from FIG. 9, the component on the negative side is larger. In FIG. 9, lines AC and DC represent the voltage of AC and DC bias, respectively, and line IP represents the potential of the latent image area. Upon this, when an imagewise exposure for forming a M toner image is applied onto the Y toner image that has earlier been developed to be electrostatically adsorbed onto the image carrier, the image carrier's surface potential in this area is lowered from, e.g., 600–700V to, e.g., −50V. In this instance, the preceding Y toner is negatively charged, so that it is pushed by the high AC voltage component rich in the foregoing negative side component, and by the action of Coulomb force, it becomes strongly pressed against the surface of the image carrier.

In practice, negative recharging is desirable to be made prior to the exposures for the M toner image formation and BK toner image formation. In that case, the Y toner image is given a much higher charge to thereby increase the image force between the toner and the surface of the image carrier, whereby the Y toner becomes strongly adsorbed onto the surface of the image carrier. For the above reason, the transferrability of the initial Y toner image is deteriorated. Accordingly, the multicolor toner image formed by superposing the M toner image and BK toner image upon the Y toner image is also deteriorated in the transferrability.

As has been explained above, in forming a multicolor image by repeating the non-contact developing with use of a two-component developer, if the image formation is performed by adding a given amount of metal oxide particles having a given specific surface at least to the toner in the developer which forms the initial toner image, a high-quality, clear multicolor image free from any transfer troubles such as irregular transfer and transfer-off spots can be obtained.

What is claimed is:

1. A method for forming an image comprising the steps of forming a plurality of toner images different in color on an image carrying member by repeating the developing of the electrostatic latent image on the image carrying member with developers containing both toner and carrier, and transferring said plurality of the toner images at a time onto a receiving material, in which the toner to be provided for at least the initial toner image formation is mixed with 0.2 to 2% by weight of metal oxide particles having a BET specific surface area determined by nitrogen adsorption of from 30 m$^2$/g to 60 m$^2$/g.

2. The method of claim 1, wherein said metal oxide is one selected from the group consisting of silicon oxide, titanium oxide, aluminum oxide, zinc oxide, tin oxide, calcium oxide, barium oxide, strontium oxide, cerium oxide, chromium oxide, nickel oxide, iron oxide and zirconium oxide.

3. The method of claim 1, wherein said metal oxide particle is covered with a layer having a high electric resistivity.

4. The method of claim 1, wherein said metal oxide particle has a volume resistivity of at least $10^6\Omega$cm.

5. The method of claim 1, wherein said step of developing the electrostatic latent image is performed in an oscillating electric field under a non-contact developing condition.

6. The method of claim 1, wherein said image carrying member comprises an organic photoreceptor.

7. The method of claim 6, wherein said photoreceptor is a function-separated-type photoreceptor comprising a carrier generating layer and a carrier transferring layer.

8. The method of claim 1, wherein said toner has a particle size of from 5 μm to 30 μm and a volume resistivity of not less than $10^{13}\Omega$cm.

9. The method of claim 1, wherein said carrier has a particle size of from 5 μm to 50 μm and a volume resistivity of from $10^{11}\Omega$cm to $10^{15}\Omega$cm.

* * * * *